US005558400A

United States Patent [19]

Poulson et al.

[11] Patent Number: 5,558,400

[45] Date of Patent: Sep. 24, 1996

[54] ADJUSTABLE HEIGHT HIGH CHAIR

[75] Inventors: Keith Poulson, Westminster; Patrick M. Bertsch, Thornton, both of Colo.

[73] Assignee: Gerry Baby Products Company, Thornton, Colo.

[21] Appl. No.: 320,906

[22] Filed: Oct. 11, 1994

[51] Int. Cl.[6] ..... A47C 3/40

[52] U.S. Cl. ..... 297/344.18; 297/153; 297/353

[58] Field of Search ..... 297/344.18, 153, 297/353; 248/157; 292/128, DIG. 38, 228

[56] References Cited

U.S. PATENT DOCUMENTS

| | | | |
|---|---|---|---|
| 283,430 | 8/1883 | Smith . | |
| 2,637,371 | 5/1953 | Boutin | 155/50 |
| 4,662,681 | 5/1987 | Favaretto | 297/349 |
| 5,007,678 | 4/1991 | DeKraker | 297/353 |
| 5,165,755 | 11/1992 | Rho | 297/345 |
| 5,232,265 | 8/1993 | Estkowski et al. | 297/353 |
| 5,238,292 | 8/1993 | Golenz et al. | 297/153 |
| 5,348,374 | 9/1994 | Kuo | 297/344.18 |
| 5,445,432 | 8/1995 | Chien | 297/344.18 |

*Primary Examiner*—Peter M. Cuomo
*Assistant Examiner*—Anthony D. Barfield
*Attorney, Agent, or Firm*—Biebel & French

[57] ABSTRACT

A high chair including a frame and a seat shell supported by the frame, the seat shell including a seat portion and a back portion. The seat shell is movable in a vertical direction relative to the frame. First guide members are mounted to a lower portion of the seat shell for engagement with side members of the frame to guide the lower portion of the seat shell, and second guide members are provided adjacent to the back portion of the seat shell for guiding an upper portion of the seat shell. A latch is associated with the second guide member whereby the seat shell may be locked in one of a plurality of predetermined positions.

22 Claims, 4 Drawing Sheets

ADJUSTABLE HEIGHT HIGH CHAIR

BACKGROUND OF THE INVENTION

The present invention relates to a high chair and, more particularly, to a high chair having a vertically adjustable shell member including a seat portion and back portion.

High chairs incorporating various functions for permitting adjustments to the high chair have been proposed to facilitate positioning of the high chair for a desired use. For example, U.S. Pat. Nos. 5,238,292 and 5,165,755 disclose high chairs with an adjustable height function whereby a child sitting in the high chair may be positioned at a convenient height. Among the desirable criteria for adjustable high chair structures is the ability to maintain a moveable seat portion at a substantially constant angular orientation as it is moved upwardly or downwardly. A locking mechanism may also be provided for positively locking the seat in place once the desired height is reached. Typically, the locking mechanism is provided along a pair of legs which form guide portions for guiding the seat in vertical movement.

While the prior art adjustable high chairs provide for adjustment and locking of the seats at different vertical positions, there is an ongoing need for a simplified and less expensive mechanism for providing height adjustments to high chairs. Further, there is a need for a mechanism which is easily manipulated to locate a seat shell at a desired height on the high chair.

SUMMARY OF THE INVENTION

The present invention provides a high chair including a frame and a seat shell supported on the frame wherein the seat shell includes a seat portion and a back portion. The seat shell is guided for vertical movement along the frame by first guide means connecting a lower portion of the seat shell to the frame and second guide means connecting an upper portion of the seat shell to the frame wherein the second guide means engages the back portion of the seat shell. In addition, the second guide means includes a latch for selectively positioning the seat shell at a plurality of vertical locations along the frame.

The first guide means preferably includes a pair of collars mounted to the seat shell and extending around the frame, and the second guide means includes a pair of elongated slots extending vertically along the back portion of the seat shell and a pair of guide fingers supported on the frame and extending into the slots.

The latch includes pawls supported on the frame adjacent to the guide fingers for engagement within recesses located at vertically spaced locations along the back portion of the seat shell. The pawls are mounted for movement toward and away from the recesses whereby the pawls may hold the seat shell at a plurality of predetermined vertical positions. In addition, the pawls are preferably spring biased toward the back portion whereby the pawls are automatically moved into engagement with the recesses.

The frame is formed having a pair of substantially vertical side members including inwardly curved upper ends to form a horizontal cross member for supporting the second guide means and latch. The side members also include forwardly curved lower ends to form a first floor engaging portion. A second floor engaging portion, including a pair of vertical portions, is attached to the side members and the vertical portions include rearwardly curved lower ends. The collars forming the first guide means are slidable along the side members of the frame between the cross member and the vertical portions of the second floor engaging portion.

Therefore, it is a general object of the invention to provide a high chair having a seat shell which is vertically adjustable.

It is a further object of the invention to provide such a high chair having an easily operated latch for positioning the seat shell at a desired height.

Other objects and advantages of the invention will be apparent from the following description, the accompanying drawings and the appended claims.

DETAILED DESCRIPTION OF THE PREFERRED EMBODIMENT

Figure 1:
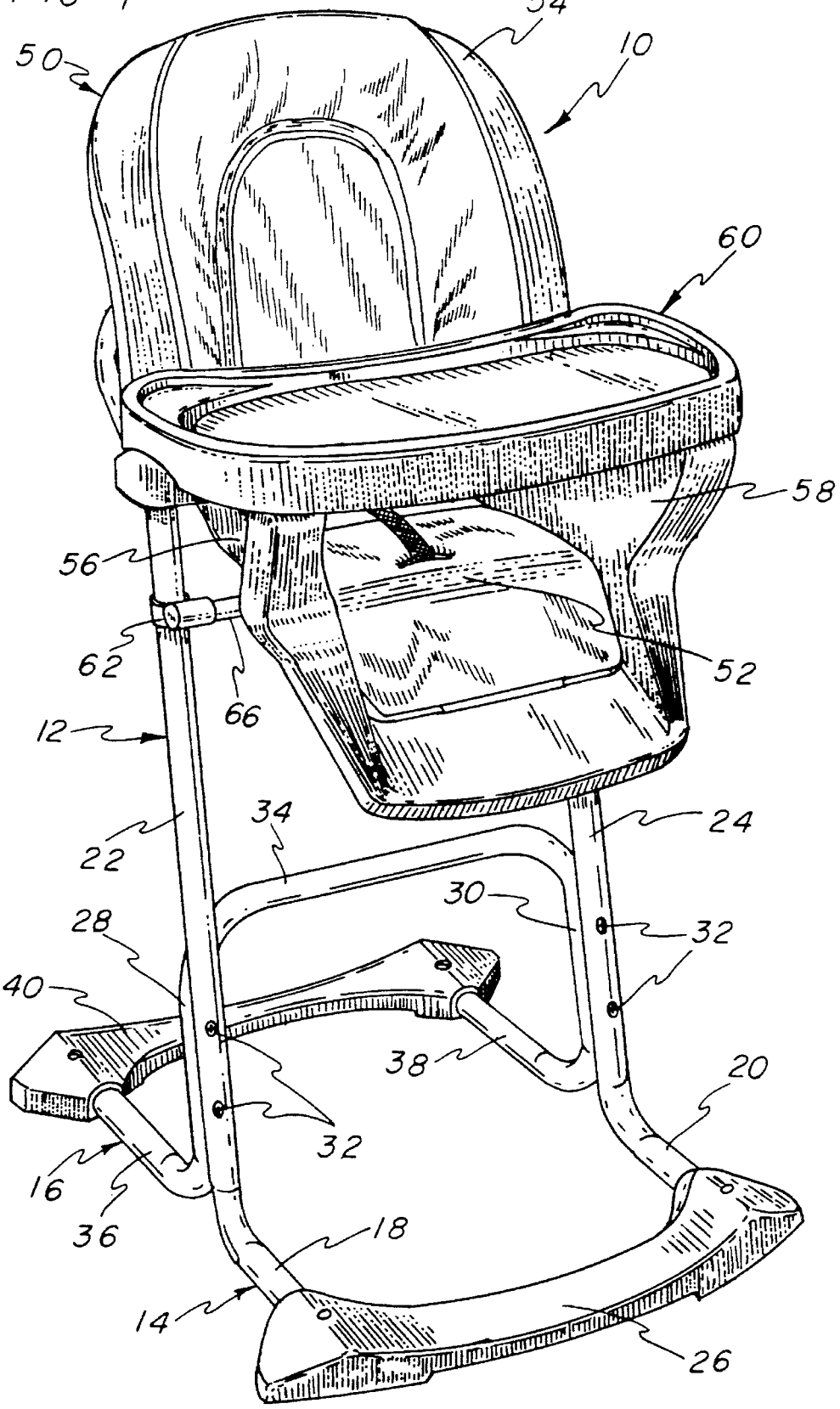
FIG. 1 is a front perspective view of the high chair of the present invention.
Figure 2:
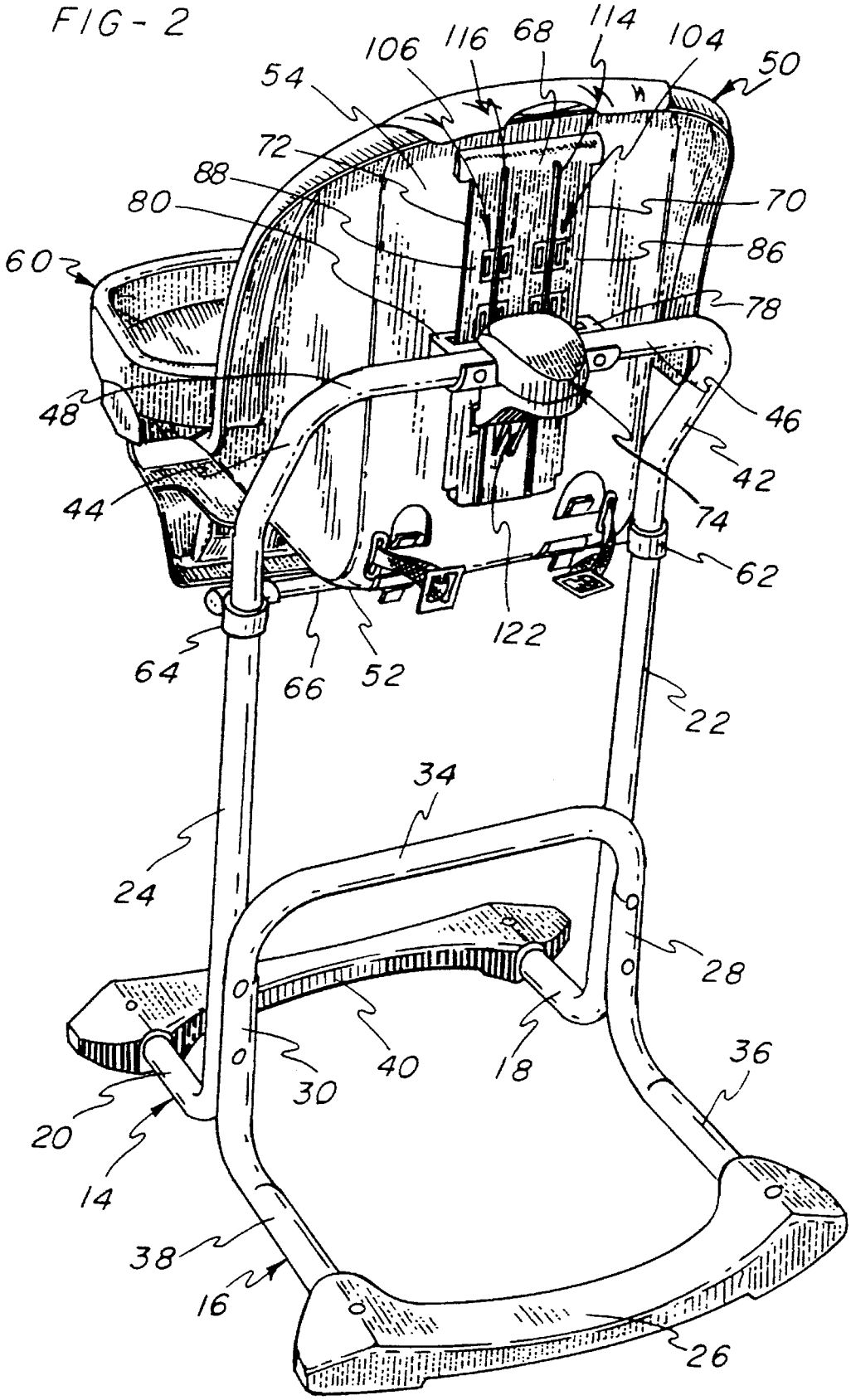
FIG. 2 is a rear perspective view of the high chair.

Referring to FIGS. 1 and 2, the high chair 10 of the present invention includes a frame 12 including a first forwardly located floor engaging portion 14 and a second rearwardly located floor engaging portion 16. The first floor engaging portion 14 is defined by forwardly extending portions 18, 20 formed integrally with and curved forwardly from substantially vertical side members 22, 24. In addition, a front foot 26 extends between the ends of the forwardly extending portions 18, 20.

The second floor engaging portion includes a pair of vertical portions 28, 30 which are attached to the side members 22, 24 by means of fasteners 32. A horizontal portion 34 extends between the upper ends of the vertical portions 28, 30 whereby a predetermined spacing is maintained between the side members 22, 24. The vertical portions 28, 30 further include rearwardly curved lower portions 36, 38, and a rear foot 40 is attached to the ends of the rearwardly extending portions 36, 38.

As best seen in FIG. 2, the side members 22, 24 each include a respective rearwardly angled upper end 42, 44. Each of the angled portions 42, 44 includes an inwardly curved portion 46, 48 defining a substantially horizontal cross member located at the back of the high chair 10. It should be noted that each of the members of the frame 12 are preferably formed of metal tubing such as steel.

As seen in FIGS. 1 and 2, the high chair 10 further includes a seat shell 50 having a seat portion 52, a back portion 54 and side portions 56, 58. In addition, the side portions 56, 58 are adapted to adjustably support a tray 60 in a conventional manner.

The seat shell 50 is supported by and is vertically adjustable relative to the frame 12. A lower portion of the seat shell 50 is guided in vertical movement by first guide means comprising ring shaped collars 62, 64 extending around respective side members 22, 24 at a vertical location between the cross member and the attachment point between the vertical portions 28, 30 of the second floor engaging portion 16 and the side members 22, 24. A transverse bar 66 extends between the collars 62, 64 and is attached to a lower surface of the seat portion 52 at attachment points 63, 65 (See FIG. 3) whereby the collars 62, 64 act to guide the seat shell 50 in its vertical movement at a lower end of the seat shell 50.

Figure 3:
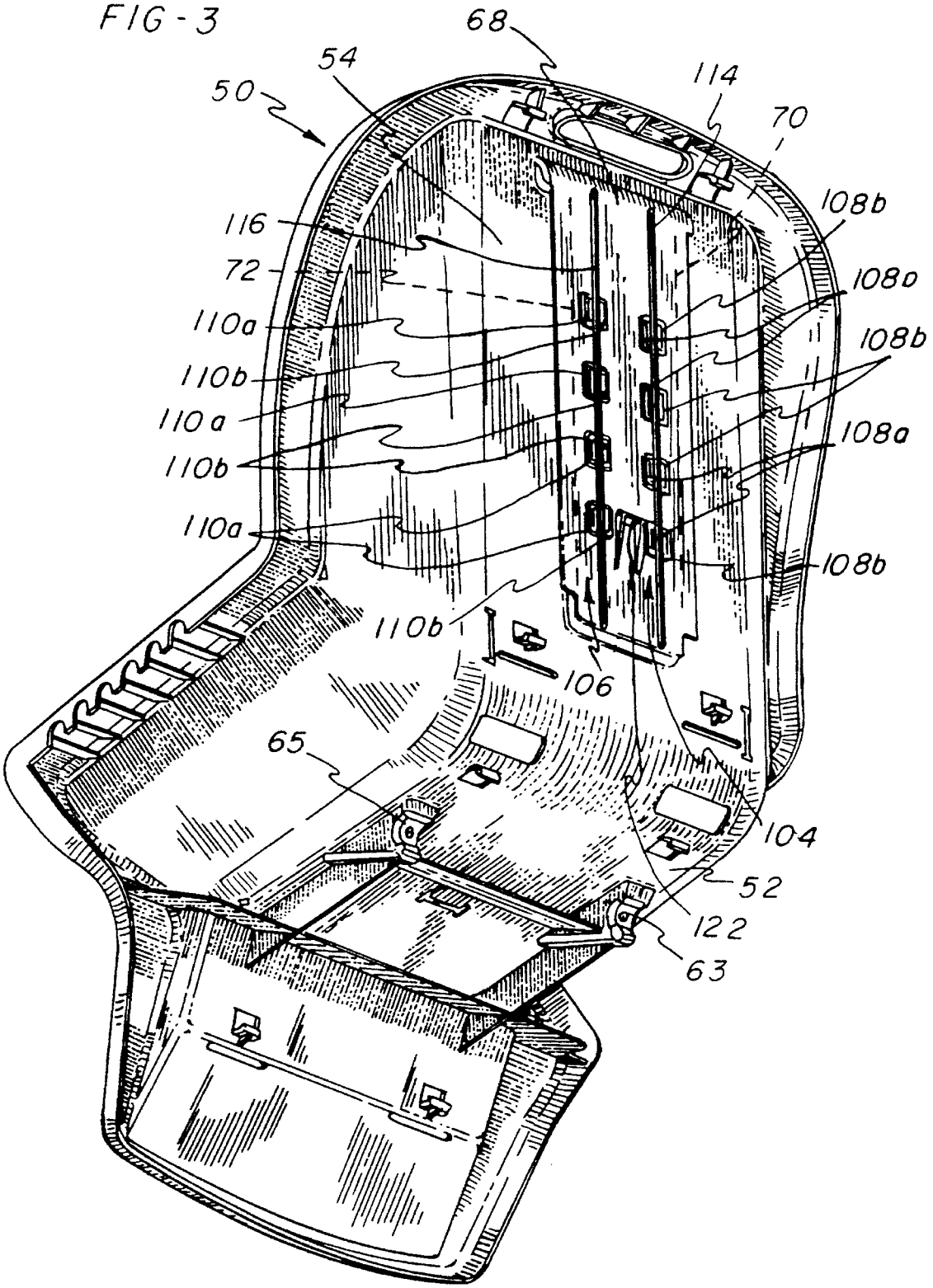
FIG. 3 is a rear perspective view of the seat shell.
Figure 5:
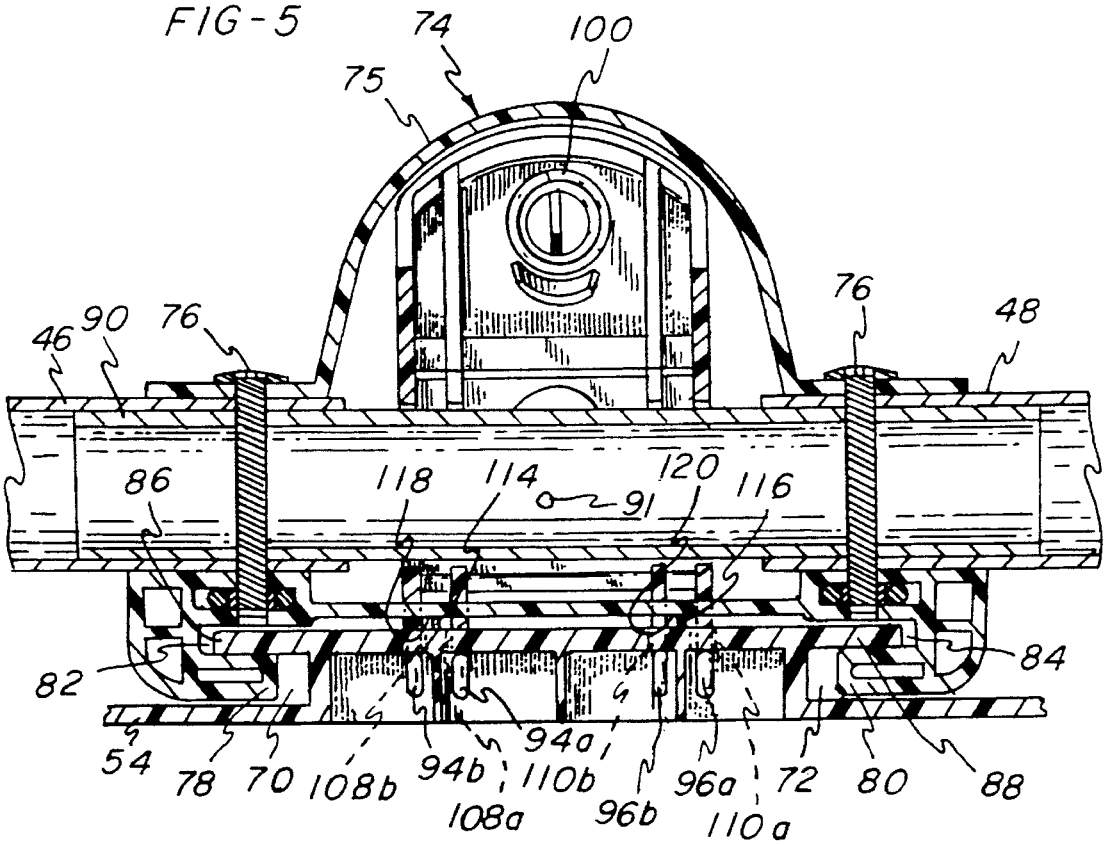
FIG. 5 is a cross-sectional view taken along line 5—5 in FIG. 4.

Referring to FIGS. 2 and 3, second guide means for guiding an upper portion of the seat shell 50 in vertical movement includes a guide plate 68 molded on the back portion 54 and defining a pair of parallel vertically extending and oppositely facing slots 70, 72. A latch mount 74 is provided including a housing 75 rigidly attached to the inwardly curved upper ends 46, 48 of the frame 12 by means of fasteners 76, as seen in FIG. 5. The latch mount includes guide fingers 78, 80 extending into the slots 70, 72, respectively. In addition, latch mount slots 82, 84 are defined by the guide fingers 78, 80 for receiving longitudinal edges 86, 88 of the guide plate 68. Thus, the guide fingers 78, 80 and slots 70, 72, as well as slots 82, 84 and plate edges 86, 88, cooperate to guide the upper portion of the seat shell during vertical movement of the seat shell 50. Further, it should be noted that the back portion 54 and slots 70, 72 on the seat shell 50 are substantially parallel to the side members 22, 24 of the frame 12 such that the seat shell 50 will be maintained in a substantially constant angular orientation during vertical movement.

Figure 4:
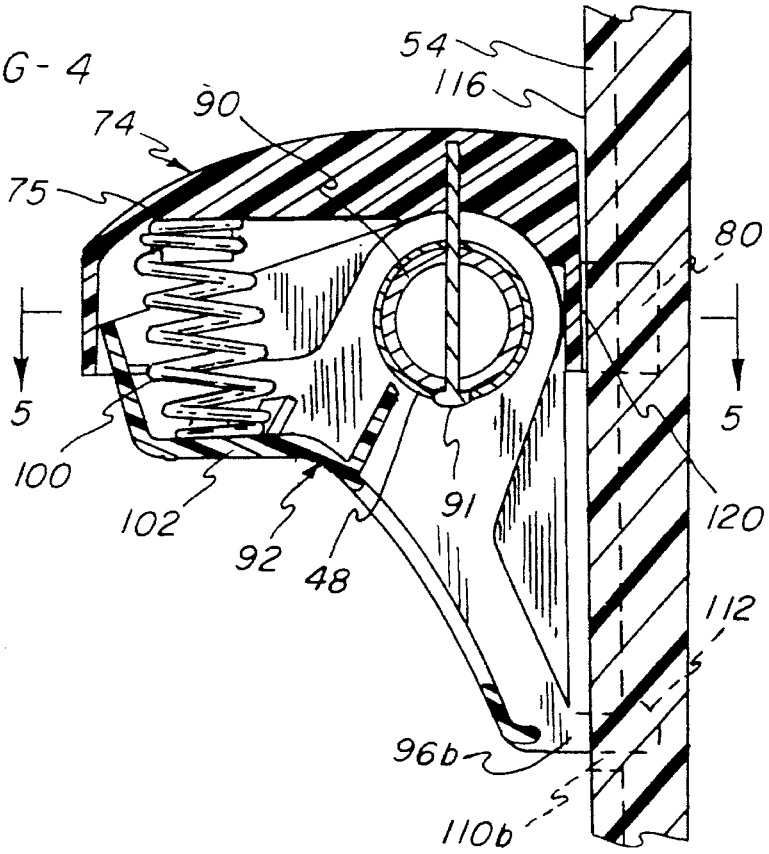
FIG. 4 is a cross-sectional elevational view through a central portion of the guide and latching mechanism for positioning the back of the high chair.

Referring to FIGS. 4 and 5, the latch mount 74 further includes a central pivot tube 90 which is non-rotatably attached to the latch mount housing 75 by means of a screw 91. A latch 92 is located at a lower portion of the latch mount housing 75 and is supported by means of the pivot tube 90 passing through a hole extending laterally through the latch 92. The latch 92 includes first and second sets of pawls 94*a*, 94*b* and 96*a*, 96*b* which are pivotally moveable about the pivot tube 90 toward and away from the back portion 54 of the seat shell 50. A compression spring 100 is located between the latch mount housing 75 and the latch 92 to bias the pawls 94*a*, 94*b*, 96*a*, 96*b* toward the back portion 54. In addition, the latch 92 includes a handle portion 102 whereby the pawls 94*a*, 94*b*, 96*a*, 96*b* may be manually pivoted away from the back portion 54 by compressing the spring 100.

Referring to FIG. 3, the guide plate 68 located on the back portion 54 further includes first and second columns 104, 106 of recesses or through apertures 108*a*, 108*b* and 110*a*, 110*b* for receiving the pawls 94*a*, 94*b* and 96*a*, 96*b* wherein the columns 104, 106 extend vertically between the slots 70, 72. Each of the aperture columns 104, 106 includes pairs of apertures 108*a*, 108*b* and 110*a*, 110*b* located at four vertically spaced locations to thereby define four predetermined vertical positions for locating the seat shell 50 relative to the frame 12. In addition, it should be noted that the pawls 94*a*, 94*b*, 96*a*, 96*b* each include a detent portion 112. The weight of the seat shell 50 causes an upper edge of the apertures 108*a*, 108*b*, 110*a*, 110*b* to move against an upper edge of the pawls 94*a*, 94*b*, 96*a*, 96*b* adjacent to the detent portion 112 whereby the detent portion 112 prevents movement of the pawls 94, 96 out of the apertures 108*a*, 108*b*, 110*a*, 110*b*. In order to unlatch the seat shell 50 from the latch 92, it is first necessary to slightly lift the seat shell to permit the detent 112 to clear the upper edge of the apertures 108*a*, 108*b*, 110*a*, 110*b* upon actuation of the handle portion 102. Thus, the latch mount 74 and latch 92 provide a simple and easily manipulated guide and latch mechanism which permits an operator to readily adjust the vertical height of the seat shell 50.

In addition, the columns 104, 106 each include a respective bearing rail 114, 116 located between the pairs of apertures 108*a*, 108*b*, 110*a*, 110*b* for each column 104, 106. The bearing rails 114, 116 are adapted to engage forwardly facing latch mount surfaces 118, 120 such that the bearing rails 114, 116 provide narrow bearing surfaces to facilitate smooth upward and downward movement of the seat shell 50 relative to the latch mount 74. In addition, it should be noted that a stop 122 is provided extending rearwardly from a lower end of the plate 68 for engaging the latch mount 74 to thereby limit upward movement of the seat shell 50.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. A high chair comprising:

a frame;

a seat shell supported on said frame, said seat shell including a seat portion and a back portion;

first guide means connecting a lower portion of said seat shell to said frame;

second guide means connecting an upper portion of said seat shell to said frame, said second guide means comprising at least one elongated slot extending vertically along said back portion and at least one guide finger supported on said frame and extending into said slot; and wherein said first and second guide means guide said seat shell in vertical movement relative to said frame, and said second guide means includes a latch for selectively positioning said seat shell at a plurality of vertical locations.

2. The high chair as recited in claim 1 wherein said first guide means includes at least one collar extending around said frame, said collar being slidable along said frame.

3. The high chair as recited in claim 1 wherein said second guide means includes a pair of elongated slots extending vertically along said back portion and a pair of guide fingers supported on said frame and extending into said slots.

4. The high chair as recited in claim 1 wherein said latch includes at least one pawl supported on said frame and the back portion includes a plurality of recesses located at vertically spaced locations for receiving said pawl whereby a plurality of predetermined vertical positions of said seat shell are defined.

5. The high chair as recited in claim 4 wherein said pawl is mounted for pivotal movement relative to said frame.

6. The high chair as recited in claim 4 including a spring biasing said pawl forwardly to engage with said recesses on said back portion.

7. The high chair as recited in claim 4 including a latch mount for supporting said latch, said second guide means including elongated slots located on said back portion and guide fingers on said latch mount extending into said slots.

8. The high chair as recited in claim 7 wherein said latch is mounted for movement relative to said latch mount such that said pawl is movable into and out of engagement with said recesses.

9. The high chair as recited in claim 8 wherein said latch is mounted to said cross-member.

10. The high chair as recited in claim 1 wherein said frame comprises a pair of substantially vertical side members extending upwardly at opposing sides of said seat shell and a substantially horizontal cross-member connecting upper ends of said side members.

11. A high chair comprising:

a frame including a pair of substantially vertical side members and a substantially horizontal cross-member extending between said side members;

a seat shell supported by said frame, said seat shell including a seat portion and a back portion;

first guide members mounted to said seat shell and in engagement with said side members for guiding a lower portion of said seat shell in vertical movement along said frame;

second guide members connecting an upper portion of said seat shell to said frame for guiding an upper portion of said seat shell in vertical movement relative to said frame, said second guide members comprising at least one elongated slot extending vertically along said back portion and at least one guide finger supported on said frame and extending into said slot; and a latch supported on said frame for engaging said seat shell to selectively position said seat shell at one of a plurality of locations along said frame.

12. The high chair as recited in claim 11 wherein said first guide members comprise collars extending around said side members, said collars being slidable along said side members.

13. The high chair as recited in claim 11 wherein said second guide members include a pair of elongated slots extending vertically along said back portion and a pair of guide fingers supported on said frame and extending into said slots.

14. The high chair as recited in claim 13 including a latch mount attached to said cross-member, said latch mount including said guide fingers and said latch being mounted to said latch mount wherein said latch is movable relative to said latch mount.

15. The high chair as recited in claim 14 wherein said latch comprises a pair of pawls extending forwardly toward said back portion and said back portion includes a plurality of recesses for receiving said pawls, said recesses defining a plurality of predetermined vertical positions for said seat shell.

16. The high chair as recited in claim 14 wherein said latch is supported for pivotal movement relative to said latch mount.

17. The high chair as recited in claim 14 wherein said latch is resiliently biased toward said back portion.

18. The high chair as recited in claim 11 wherein said frame includes a first floor engaging portion extending in a first horizontal direction and including a second floor engaging portion extending in a second horizontal direction, opposite said first horizontal direction, said second floor engaging portion being attached to said side members below said first guide members.

19. A high chair comprising:

a frame including a pair of substantially vertical side members having inwardly curved upper ends to form a substantially horizontal cross-member, said side members further including forwardly curved lower ends to form a first floor engaging portion;

a second floor engaging portion including a pair of vertical portions attached to said side members, said vertical portions including rearwardly curved lower ends;

a seat shell located forwardly of said cross-member, said seat shell including a seat portion and a back portion;

a pair of parallel slots extending in a vertical direction along said back portion, said slots facing in opposite directions;

two columns of apertures extending vertically along said back portion between said pair of slots;

a latch mount rigidly attached to a central portion of said cross-member, said latch mount including a pair of guide fingers positioned within said slots;

a latch pivotally mounted to said latch mount, said latch including pawls for engaging within said apertures and further including a handle for moving said latch relative to said latch mount;

a spring positioned between said latch and said latch mount for biasing said pawls into engagement with said apertures;

a pair of collars attached to said seat shell, said collars extending around said side members and being slidable along said side members between said cross-member and said vertical portions of said second floor engaging portion; and wherein said seat shell is guided in vertical movement by said guide fingers and said slots at an upper end of said seat shell and by said collars and said side members at a lower end of said seat shell, and said latch is operable to selectively lock said seat shell in a plurality of predetermined positions relative to said frame.

20. A high chair comprising:

a frame including a pair of substantially vertical side members and a substantially horizontal cross-member extending between said side members;

a seat shell supported by said frame, said seat shell including a seat portion and a back portion;

first guide members mounted to said seat shell and in engagement with said side members for guiding a lower portion of said seat shell in vertical movement along said frame;

second guide members connecting an upper portion of said seat shell to said frame for guiding an upper portion of said seat shell in vertical movement relative to said frame, said second guide members comprising at least one elongated slot extending vertically along said back portion and at least one guide finger supported on said frame and extending into said slot; and a latch cooperating between said seat shell and said frame to selectively position said seat shell at one of a plurality of locations along said frame.

21. The high chair as recited in claim 20 wherein said first guide members comprise collars extending around said side members.

22. The high chair as recited in claim 20 wherein said second guide members comprise a pair of elongated slots extending vertically along said back portion and a pair of guide fingers supported on said horizontal cross-member and extending into said slots.

* * * * *